US006408755B1

(12) United States Patent
Meisters et al.

(10) Patent No.: US 6,408,755 B1
(45) Date of Patent: Jun. 25, 2002

(54) METHOD FOR ERASING A LITHOGRAPHIC PRINTING MASTER

(75) Inventors: Augustin Meisters, Gentbrugge; Joan Vermeersch, Deinze; Luc Leenders, Herentals; Bavo Muys, Eppegem, all of (BE)

(73) Assignee: Agfa-Gavaert, Mortsel (BE)

( * ) Notice: Subject to any disclaimer, the term of this patent is extended or adjusted under 35 U.S.C. 154(b) by 0 days.

(21) Appl. No.: 09/638,877

(22) Filed: Aug. 15, 2000

Related U.S. Application Data

(60) Provisional application No. 60/155,769, filed on Sep. 27, 1999.

(30) Foreign Application Priority Data

Aug. 31, 1999 (EP) ..... 99202799

(51) Int. Cl.[7] ..... B41M 1/06; B41C 1/10

(52) U.S. Cl. ..... 101/478; 101/463.1; 101/465; 101/467

(58) Field of Search ..... 101/453, 454, 101/458, 459, 463.1, 465, 466, 467, 478

(56) References Cited

U.S. PATENT DOCUMENTS

| | | | | | |
|---|---|---|---|---|---|
| 3,679,418 | A | * | 7/1972 | Stroszynski | 101/456 |
| 4,292,397 | A | * | 9/1981 | Takeuchi et al. | 101/456 |
| 4,718,340 | A | * | 1/1988 | Love, III | 101/467 |
| 4,777,109 | A | | 10/1988 | Gumbinner et al. | 430/155 |
| 5,062,364 | A | * | 11/1991 | Lewis et al. | 101/467 |
| 5,272,979 | A | * | 12/1993 | Lewis et al. | 101/467 |
| 5,317,970 | A | | 6/1994 | Nussel et al. | 101/478 |
| 5,870,955 | A | * | 2/1999 | Williams et al. | 101/453 |
| 6,024,019 | A | * | 2/2000 | Williams et al. | 101/463.1 |

FOREIGN PATENT DOCUMENTS

| | | | |
|---|---|---|---|
| EP | 0 821 273 A1 | | 1/1998 |
| JP | 56-14238 | * | 2/1981 |
| JP | 319427 | * | 11/2000 |

* cited by examiner

*Primary Examiner*—Stephen R. Funk
(74) *Attorney, Agent, or Firm*—Breiner & Breiner, L.L.C.

(57) ABSTRACT

A method is disclosed for removing ink accepting areas of a printing surface of a lithographic printing master by treatment with an atmospheric plasma. Preferably, the plasma is directed to the printing surface as a plasma jet while the printing master is mounted on the plate cylinder of a printing press. The method enables to clean a support of a printing master and then reuse the cleaned support for making another printing master. Preferably, all the following steps are performed on-press:

(i) making an imaging material by providing a support with an image recording layer; (ii) making a printing master having a printing surface comprising ink accepting areas by image-wise exposing and optionally developing the imaging material; (iii) starting a pressrun; (iv) a cleaning step using an atmospheric plasma and then repeating steps (i) to (iv).

7 Claims, 1 Drawing Sheet

METHOD FOR ERASING A LITHOGRAPHIC PRINTING MASTER

This application claims benefit of Ser. No. 60/155,769 filed Sep. 27, 1999.

FIELD OF THE INVENTION

The present invention relates to a method for erasing the image of a lithographic printing master by treating the printing surface with an atmospheric plasma.

BACKGROUND OF THE INVENTION

Printing presses use a so-called master such as a printing plate which is mounted on a cylinder of the printing press. The master carries an image which is defined by the ink accepting areas of the printing surface and a print is obtained by applying ink to said surface and then transferring the ink from the master onto a substrate, which is typically a paper substrate. In conventional lithographic printing, ink as well as an aqueous fountain solution are fed to the printing surface of the master, which consists of oleophilic (i.e. ink accepting) and hydrophilic (water accepting) areas. In driographic printing, only ink is applied to the printing surface, which consists of ink accepting and ink repelling areas. These ink-repelling areas are often called oleophobic or ink-abhesive areas. Driographic plates are sometimes simply called 'dry' plates as distinct from the conventional 'wet' plates.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an imagesetter. After processing, the film can be used as a mask for the exposure of an imaging material called plate precursor and after plate processing, a printing plate is obtained which can be used as a master.

In recent years the so-called computer-to-plate method has gained a lot of interest. This method, also called direct-to-plate method, bypasses the creation of film because the digital document is transferred directly to a plate precursor by means of a so-called plate-setter. In the field of such computer-to-plate methods the following improvements are being studied presently:

(i) On-press imaging. A special type of a computer-to-plate process, involves the exposure of a plate precursor while being mounted on a plate cylinder of a printing press by means of an image-setter that is integrated in the press. This method may be called 'computer-to-press' and printing presses with an integrated image-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. The best known imaging methods are based on ablation. A problem associated with ablative plates is the generation of debris which is difficult to remove and may disturb the printing process or may contaminate the exposure optics of the integrated image-setter. Other methods require processing with chemicals which may damage the electronics and other devices of the press.

(ii) On-press coating. Whereas a plate precursor normally consists of a sheet-like support and one or more functional coatings, computer-to-press methods have been described wherein a composition, which is capable to form a printing surface upon image-wise exposure and optional processing, is provided directly on the surface of a plate cylinder of the press. EP-A 101 266 describes the coating of a hydrophobic layer directly on the hydrophilic surface of a plate cylinder. After removal of the non-printing areas by ablation, a master is obtained. U.S. Pat. No. 5,713,287 describes a computer-to-press method wherein a so-called switchable polymer such as tetrahydropyranyl methylmethacrylate is applied directly on the surface of a plate cylinder. The switchable polymer is converted from a first water-sensitive property to an opposite water-sensitive property by image-wise exposure. EP-A 802 457 describes a hybrid method wherein a functional coating is provided on a plate support that is mounted on a cylinder of a printing press.

(iii) Elimination of chemical processing. The development of functional coatings which require no processing or may be processed with plain water is another major trend in plate making. WO 90002044, WO 91008108 and EP-A 580 394 disclose such plates, which are all ablative plates. These methods require typically multi-layer materials, which makes them less suitable for on-press coating. A non-ablative plate which can be processed with plain water is described in e.g. EP-A 770 497 and EP-A 773 112. Such plates also allow on-press processing, either by wiping the exposed plate with water while being mounted on the press or by the fountain solution during the first runs of the printing job.

(iv) Thermal imaging. Most of the computer-to-press methods referred to above use so-called heat-mode materials, i.e. plate precursors or on-press coatable compositions which comprise a compound that converts absorbed light into heat. The heat which is generated on image-wise exposure triggers a (physico-)chemical process, such as ablation, polymerization, insolubilization by cross-linking of a polymer, decomposition, or particle coagulation of a thermoplastic polymer latex. In addition to some of the disadvantages of the prior art materials and methods, indicated above, a major problem associated with all the known non-ablative thermal materials is the limited shelf life. Because these materials all contain one or more reactive compounds, the stability is highly dependent on temperature and/or humidity conditions during storage.

Most high quality printing jobs require the use of a printing master which comprises a metal support characterized by a good dimensional stability, e.g. a printing plate comprising an aluminum support. Since the metal support is an expensive component of the printing master, it would be advantageous to provide a method for removing the printing surface from the support so that it can be reused for making another printing master. Also in on-press coating methods it is necessary to remove the coating from the cylinder by a cleaning step. Such a cleaning step is preferably carried out on-press by a fast, environment-friendly and simple operation which enables easy automatization, thereby obtaining a more efficient workflow which is characterized by improved convenience and a short press down-time between printing jobs.

Methods which have been proposed in the prior art for erasing a printing master typically involve mechanical cleaning by scraping, chipping or rubbing, e.g. in U.S. Pat. No. 5,188,033. However, such abrasive methods may damage the metal support. EP-A 594 097 describes the use of solvents for removing the printing layers from a metal support. Solvents however are secondary wastes which need to be collected during the cleaning step and then disposed off.

EP-A 570 879 describes a method using a jet of pressurized water for erasing a lithographic printing master obtained by image-wise thermal transfer of an ink accepting layer. In addition to the problem of collecting the water, as in the methods using a solvent mentioned above, the use of water is to be avoided as it may cause corrosion of the metal parts of the printing press.

U.S. Pat. No. 5,317,970 describes the use of a plasma treatment to erase a lithographic printing master. However, the latter method is not convenient because it involves the use of a high-vacuum plasma chamber. Moreover, it is mentioned in the latter patent that plasma treatment at atmospheric pressure is only possible at very high temperatures which results in a damaged printing form.

OBJECTS OF THE INVENTION

It is an object of the present invention to provide an improved method for removing ink accepting areas of the printing surface of a lithographic printing master by a fast, environment-friendly, convenient and simple cleaning step which enables easy automatization. More specifically, it is an object of the present invention to provide a cleaning method which is not abrasive, which produces no secondary wastes such as solvents, which does not use corrosive liquids such as water or hazardous chemicals and which can be used at ambient temperature and atmospheric pressured;

It is another object of the present invention to use such a method for cleaning a reusable support of an imaging material which is suitable for making a lithographic printing master, thereby obtaining a more efficient workflow which is characterized by improved convenience and a short press down-time between printing jobs.

Further objects and advantages of the present invention will become apparent from the following description. These objects and advantages are obtained by preferred embodiments of the present invention which are specified in the dependent claims.

DETAILED DESCRIPTION OF THE INVENTION

Figure 1:
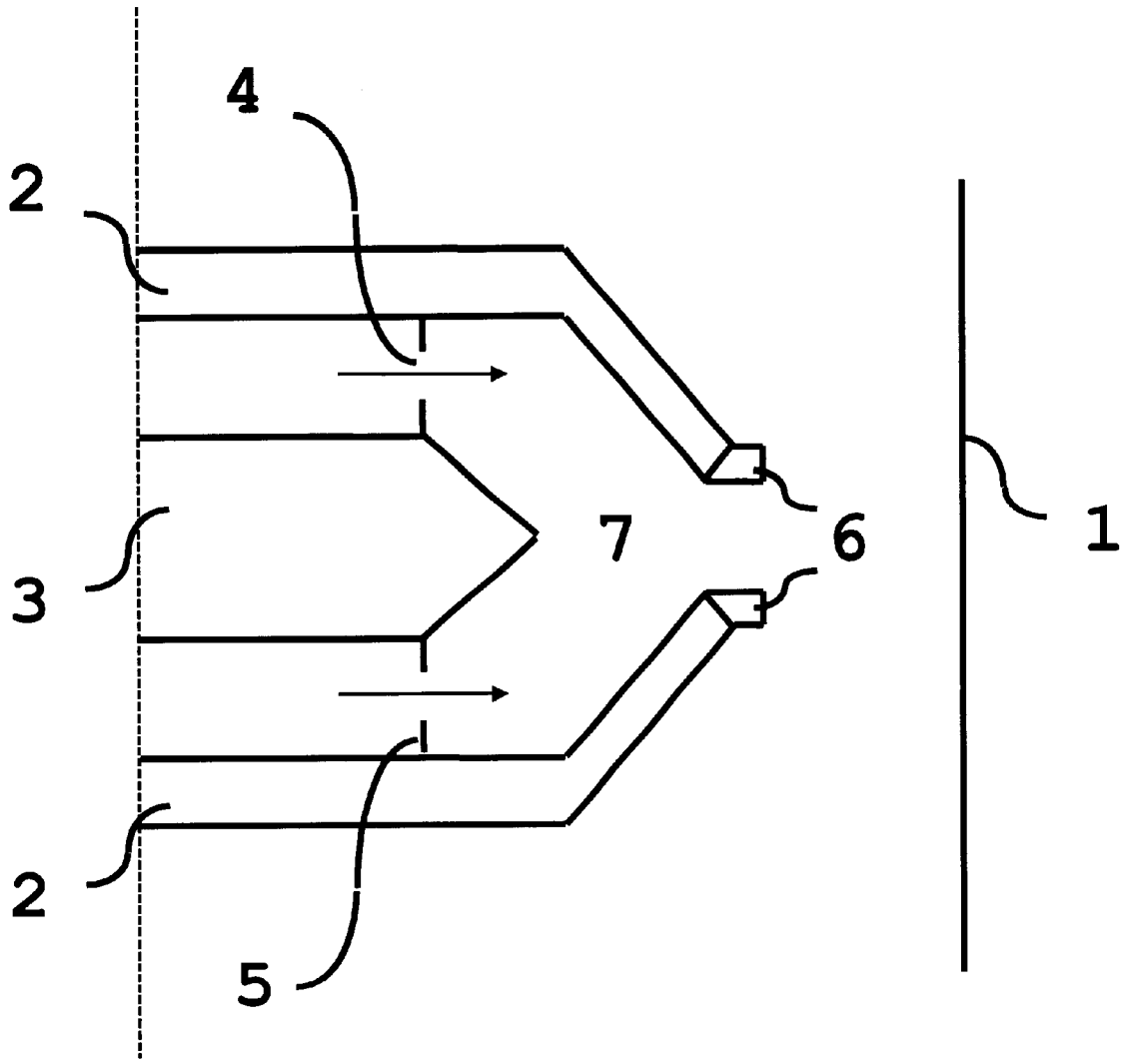
FIG. 1 shows a schematic representation of a section of an atmospheric plasma jet generator for use in the methods of the present invention.

According to the present invention, the image of a lithographic printing master is erased by treating the printing surface thereof with a glow discharge plasma that is capable of operating at one atmosphere of pressure, hereinafter referred to as "atmospheric plasma". The atmospheric plasma is capable of converting ink accepting areas of the printing master to hydrophilic areas, thereby erasing the lithographic image of the printing master.

Methods for generating an atmospheric plasma are known in the art. EP-A 821273 describes atmospheric plasma treatment of a polyester support for improving the adherence of coated layers. Also WO 96/38311 describes cleaning methods using atmospheric plasma treatment, wherein the substrate to be cleaned is used as an electrode for generating the glow discharge. None of these prior art documents, however, describes a method for erasing the image from a printing surface of a lithographic printing master.

According to a highly preferred embodiment of the present invention, an atmospheric plasma jet is used for erasing the printing master. According to such a method, a concentrated plasma jet is generated through an arc discharge between two electrodes while feeding a working gas. The electric arc is not transferred to the surface of the material that is exposed to the plasma jet. Such a method allows to treat a material without using it as an electrode for generating the plasma, i.e. also non-conducting surfaces can be cleaned by a plasma jet. A preferred embodiment of an atmospheric plasma jet generator for use in the present invention comprises a nozzle of which a section is shown in FIG. 1. The nozzle comprises a nozzle pipe 2 of which the internal diameter acts as a flow channel for working gas which is driven (indicated by the arrows in FIG. 1) into a plasma chamber 7 through perforations 4 in wall 5. A glow discharge is sustained in the plasma chamber 7 by a voltage between the inner pin electrode 3 and outer ring electrode 6. The working gas which enters the plasma chamber 7 continuously expels the plasma out of the nozzle towards the surface 1. Simultaneously, the gas also acts as a cooling medium. More details of a suitable atmospheric plasma jet generator are described in U.S. Pat. No. 5,837,958. The voltage for driving the plasma generator is preferably a high-frequency alternating voltage in the range of 10 to 30 kV as described in German Patentschrift DE 42 35 766 C1.

The plasma may be formed in air at about one atmosphere of pressure. The plasma may also be formed at pressures below or above atmospheric pressure, if desired. Working gases other than air may also be used, e.g. the noble gases such as helium, neon or argon as well as oxygen, nitrogen, nitrous oxide, carbon dioxide or mixtures thereof.

The plasma jet is preferably directed towards the printing surface of the lithographic printing master while scanning the plasma jet over said surface. Such scanwise treatment is preferably carried out while the printing master is mounted on a cylinder. During the cleaning step, one or more nozzles may be translated along a path parallel to the axis of the cylinder, while rotating said cylinder, so as to treat the whole surface of the printing master. The latter method is especially suitable for cleaning while the printing master is mounted on rotary printing presses. Other methods are also possible, e.g. a so-called flat-bed configuration wherein the surface of the printing master is essentially planar and the plasma jet is scanned over said surface in one direction while moving the printing master in another direction, perpendicular to the former.

The methods of the present invention can be used in computer-to-plate (off-press exposure) or computer-to-press (on-press exposure) procedures. Preferably, means for erasing the printing master such as the nozzle described above are integrated in the printing press. Alternatively, said means may be integrated in a dedicated cleaning apparatus nearby the printing press. In said alternative embodiment, the cleaning apparatus may be mechanically coupled to the printing press so that the printing master can be transferred automatically between the printing press and the cleaning apparatus.

The cleaning method described above allows to make fully automatic printing presses wherein all the following steps are performed on-press: (i) making an imaging material (the printing master precursor) by providing a support with an image recording layer; (ii) making a printing master by image-wise exposing and optionally developing the imaging material; (iii) starting a pressrun; and (iv) cleaning the printing master using an atmospheric plasma as described above. After cleaning, the support can again be provided with an image recording layer and after exposure and optional development, a next print job can be started.

The support used in the present invention can be, e.g. a (plate) cylinder of a rotary printing press, a sheet, a plate, a sleeve or a belt. The support may be mounted on a cylinder of a printing press while being provided with a recording layer, or while being exposed, processed or cleaned according to the present invention. The support can be a plastic support but is preferably a metal plate., e.g. polished stainless steel or, more preferably, aluminum. Phosphor bronze (an alloy comprising >90 wt. % of copper, <10 wt. % of tin and small amounts of phosphor) can also be used. Alternatively, the support can also be a composite material, e.g. a material comprising carbon fiber. When used for wet lithographic printing, the support is preferably hydrophilic or provided with a hydrophilic coating, e.g. grained and anodized aluminum. When used for dry lithographic printing, the support is preferably ink-abhesive or provided with an ink-abhesive coating, e.g. a silicone or a fluoropolymer coating. It shall be understood that the wording 'providing a support with an image recording layer' as used herein also includes embodiments wherein said recording layer is provided on top of another layer which is carried by said support, e.g. the hydrophilic or ink-abhesive layer mentioned above.

The recording layer may be image-wise exposed by applying heat or light to the layer. Light exposure includes exposure to light in heat-mode and in photo-mode, i.e. the imaging mechanism can be triggered directly by the energy of the photons or indirectly by the heat generated upon light absorption. Highly preferred image recording compositions for use in the method of the present invention have been disclosed in European Patent Application (EP-A) Nos. 98202381 and 98202382, both filed on the Jul. 16th, 1998, and EP-A No. 98203497, filed on the Oct. 15th, 1998. The teaching of these copending and co-owned applications is repeated below in a summarized form. The problem of cleaning the support after the pressrun was left unsolved by the co-owned EP-As cited above, because the printing surface of the imaging materials described therein cannot easily be erased by the known cleaning liquids.

The imaging materials, which have been described in the co-owned EP-As referred to above, are negative-working materials which comprise a light absorbing compound and may further comprise so-called reactive compounds and non-reactive compounds, each of which will be discussed hereafter. These compounds may be present in a stack of layers provided on the support but a single layer is preferred. The light absorbing compound may be present in all the layers of said stack or may be localized in just a single layer of said stack, said single layer being the recording layer of the material. In a material according to the latter embodiment the recording layer is preferably applied directly on the support.

The imaging materials, which have been described in the co-owned EP-As referred to above, comprise a light absorbing compound as main compound, i.e. present in an amount not less than 50% relative to all the compounds present in the layer(s) that are provided on the support. In a preferred embodiment the amount of light absorbing compound is not less than 70% by weight and even more preferably not less than 90% by weight relative to the layer(s) of the imaging material, excluding the support. In a highly preferred embodiment the recording layer consists essentially of a light absorbing compound. Mixtures of light absorbing compounds can also be used, and then, the total amount of all light absorbing compounds relative to all the compounds in the imaging material excluding the support is not less than 50% by weight, preferably not less than 70% by weight and even more preferably not less than 90% by weight.

Useful light absorbing compounds for use in the present invention are for example organic dyes, carbon black, metal carbides, borides, nitrides, carbonitrides, or oxides. The imaging materials used in the present invention are preferably heat-mode materials which are sensitive to near infrared light. Accordingly, the light absorbing compound is preferably a near infrared light absorbing compound. Carbon, graphite, soot and the infrared dyes of which the structural formulas are listed in the co-owned EP-As cited above are preferred. It is also possible to use polymers such as a polypyrrole, polyethylenedioxithiophene or polyaniline-based polymer.

The recording layer is preferably characterized by a very thin layer thickness, i.e. a dry layer thickness below 1 $\mu$m, preferably below 0.5 $\mu$m and even more preferably ranging from 0.25 to 0.1 $\mu$m. A layer thickness below 0.1 $\mu$m may still give satisfactory results. For instance, it was observed that an anodized aluminum support which is provided with a 0.1 $\mu$m graphite layer, then wiped thoroughly with a dry cloth and then image-wise exposed in heat-mode, still provides an excellent printing master. Microscopic analysis of the exposed areas of this material indicates that the thin graphite layer is not or only partially ablated from the underlying support and that the exposed areas of the graphite layer are converted into an ink accepting phase which cannot be removed by printing, i.e. which is resistant to rubbing and is insoluble in ink or fountain. Although the imaging mechanism of such materials is not completely clear, it seems that a significant amount of the recording layer is converted upon exposure into an ink accepting substance which defines a printing area on the plate. This conversion can be a chemical reaction of the light absorbing compound itself but also other compounds present in the imaging material can be involved. In some embodiments, the light absorbing compound may only act as a light-to-heat convertor which triggers the conversion of another compound into an ink accepting phase.

The heat-mode materials known prior to the above co-owned EP-As generally comprise a light absorbing compound in a typical amount relative to all the compounds in the imaging material, excluding the support, of 1 to 10% by weight, and one or more reactive compounds. The feature "reactive compound" shall be understood as a compound which undergoes a (physico-)chemical reaction due to the heat generated during image-wise exposure. Examples of such reactive compounds are thermoplastic polymer latex, diazo resins, naphtoquinone diazide, photopolymers, resole and novolac resins, or modified poly(vinyl butyral) binders. More examples can be found in J. Prakt. Chem. Vol. 336 (1994), p. 377–389. Due to the presence of such reactive compound(s), care must be taken with regard to storage conditions to guarantee a long shelf life of these prior art material. Preferred materials used in the present invention comprise less than 20% by weight of such other reactive compounds besides the light absorbing compound. Such materials exhibit an excellent stability: they can be stored during 2 minutes at 100°0 C. without toning (ink acceptance in non-exposed areas), contrary to conventional thermal lithographic printing plate precursors which show significant toning when exposed to the above conditions. Some materials, especially those comprising carbon as a light absorbing compound, can even be stored during 2 minutes at 150° C. without noticeable toning.

More preferably the amount of said reactive compounds is less than 10% by weight and most preferably, the imaging material is substantially free from reactive compounds other than the light absorbing compound. The words "substantially free" shall be understood as meaning that a small ineffective amount of such reactive compounds may be present in addition to the light absorbing compound. Said small ineffective amount is not essential for or does not significantly contribute to the imaging process of the material.

The imaging materials that are used in the present invention may further comprise non-reactive compounds, i.e. inert components such as e.g. a binder, surfactant, matting agent or filler. The word "inert" shall not be understood in the meaning of "non-functional", since these inert compounds may be added to the image recording composition to adjust certain physical properties, such as e.g. surface roughness, friction coefficient, viscosity or dimensional stability. The word "inert" shall rather be understood as meaning "not essential for the imaging process", though some inert compounds may have a (minor) influence on the speed and image quality of the imaging material.

Examples of such inert compounds are hydrophilic binders, e.g. carboxymethyl cellulose, homopolymers and copolymers of vinyl pyrrolidone, vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers. The amount of hydrophilic binder in the layer(s) provided on the support is preferably less than 40% by weight and more preferably between 5 and 20% by weight.

A highly preferred imaging material for wet lithographic printing according to the present invention comprises a grained and anodized aluminum support and provided directly thereon a single layer which consists essentially of a light absorbing compound such as carbon, graphite or soot as is substantially free from other reactive compounds. After heat-mode exposure and applying fountain solution during the first runs of the print job, the exposed areas of said material are ink-accepting and the recording layer has been removed at non-exposed areas, thereby exposing the fountain accepting anodized aluminum support.

When used for driographic printing according to the present invention, the recording layer is preferably provided on top of a silicone layer. After heat-mode exposure and applying fountain solution during the first runs of the print job, the exposed areas of the material are ink-accepting and the recording layer has been removed at non-exposed areas, thereby exposing the ink-abhesive silicone layer. In a preferred embodiment, the ink-abhesive layer is a silicone coating which contains one or more components one of which is generally a linear silicone polymer terminated with a chemically reactive group at both ends and a multifunctional component as a hardening agent. The silicone coating is preferably crosslinked, e.g. by condensation curing, addition curing or radiation curing. The ink-abhesive layer may also comprise other ingredients, e.g. plasticizers, pigments, dyes, etc.

The recording layer can be applied on the support by coating or spraying an image recording composition. Said composition can be applied directly on the surface of a cylinder of a rotary printing press. More preferably, such image recording composition is applied on a sheet or belt which is mounted on a cylinder of a rotary printing press. On-press coating of a recording layer can be carried out by using the inking system of the plate cylinder as a coating system. In still another method according to the present invention, said composition can be applied off-press in a dedicated coating apparatus on a plate or sleeve which, after image-wise exposure and optional processing, is then transferred to a cylinder of a rotary printing press. Preferably said coating apparatus is mechanically coupled to said printing press so that the imaging material can be transferred automatically to the printing press.

Coating or spraying an aqueous dispersion of carbon or a solution of an organic dye are preferred methods according to the present invention for applying a recording layer on the support. Jet methods such as ink jet or toner jet can be used as an alternative coating technique, whereby either a uniform layer of light absorbing compound is jet-coated on the support and then image-wise exposed or whereby the light absorbing compound is image-wise applied to the support and then rendered ink accepting by intense heating, e.g. by laser exposure.

In a highly preferred method of the present invention, a support can also be provided with a recording layer by rubbing in the support with a dry powder comprising a light absorbing compound, e.g. carbon or an organic dye. Again, said support may already have been provided with another layer before being rubbed in with said dry powder. Alternative dry coating methods can also be used, e.g. sputter-coating of carbon or direct electrostatic printing (toner jet). The latter technique can be used to apply the dry powder image-wise and after intense overall heating, e.g. by infrared laser exposure, a printing master is obtained. Said infrared laser can be mounted on the same carriage as the direct electrostatic printing head.

The recording layer may also be applied as a dry powder by contacting the support with another material, which carries a dry layer containing a light absorbing compound which is then transferred to the support. Suitable examples are rubbing in the support with ashes, charcoal, or a semi-burned piece of organic material such as a cork or wood. The method of the latter embodiment can be automated easily, e.g. by incorporating a supply roll of such a transfer material, such as a ribbon impregnated with light absorbing compound or carrying a recording layer comprising a binder and a light absorbing compound, in a print station of a digital press similar to the configuration which is described in EP-A 698 488. The transfer material can be unwound from said supply roll and the side containing the light absorbing compound can then be brought into direct contact by one or more contact rollers with the surface of a plate cylinder or a support mounted thereon. After the transfer step, which may be carried out by applying pressure and/or heat on said transfer material while being in contact with the support, the used transfer material may be wound up again on a take-up roll. In the latter embodiment, the transfer can be carried out so as to obtain a uniform layer which then can be image-wise exposed. Alternatively said pressure and/or heat can be applied image-wise, so that the light absorbing compound or recording layer is transferred image-wise to the support. This step then may be followed by intense overall heating, e.g. by laser exposure. However, if sufficient heat is applied during said image-wise transfer, a suitable printing master may directly be obtained without said intense heating.

In another preferred embodiment of the present invention the recording layer consists essentially of or comprises soot as a light absorbing compound, i.e. the black carbon obtained from the incomplete combustion of organic materials such as oils, wood, natural gas, acetylene, coal, wax or cork. Said soot may even be applied by contacting the support with a flame obtained by burning said organic material. Preferably the surface of the support is contacted with the colder part of the flame where combustion is incomplete, e.g. the yellow end of the flame of a candle. Electron microscopic images of materials made in this way show the presence of submicron soot particles.

Depending on the thickness of the recording layer and on the method used for applying this layer, the recording layer may be a continuous or a non-continuous layer. Especially when a thin layer of soot is deposited by incomplete combustion, electron microscopic images reveal that some submicron areas are not completely covered by the soot particles. It shall be understood that the feature "recording layer" also embraces a non-continuous layer, irrespective of the scale of the non-covered areas, which may be even macroscopic, e.g. in the case of image-wise application of a recording layer as discussed above.

The above embodiments, wherein carbon or an organic compound is used as main component of the recording layer shows many benefits over prior art computer-to-press methods: the composition is highly stable and shows excellent shelf-life, the composition can easily be applied by the on-press coating methods described herein, the coated layer shows high sensitivity for heat-mode imaging by a laser using an internal as well as an external drum configuration, the exposed layer is developed simply by applying a conventional dampening liquid, the lithographic performance of the printing master thus obtained is excellent, and after the pressrun, the printing surface can be erased easily using the atmospheric plasma treatment described above. The support can then be re-coated and, after exposure and optional development, another print job can be started.

Preferred imaging materials used in the present invention can be exposed to light by a light emitting diode or a laser such as a He/Ne or Ar laser. Preferably a laser emitting near infrared light having a wavelength in the range from about 700 to about 1500 nm is used, e.g. a semiconductor laser diode, a Nd:YAG or a Nd:YLF laser. The required laser power depends on the pixel dwell time of the laser beam, which is determined by the spot diameter (typical value of modern plate-setters at $1/e^2$ of maximum intensity: 10–25 $\mu$m), the scan speed and the resolution of the exposure device (i.e. the number of addressable pixels per unit of linear distance, often expressed in dots per inch or dpi; typical value: 1000–4000 dpi). A major benefit of preferred materials is that they can be used as a universal imaging material which is suitable for exposure by internal (ITD) as well as external drum (XTD) image-setters. ITD image-setters are typically characterized by a very high scan speed up to 500 m/sec and may require a laser power of several Watts. Satisfactory results have also been obtained by using XTD image-setters having a typical laser power from about 200 mW to about 1 W at a lower scan speed, e.g. from 0.1 to 10 m/sec.

After exposure, the imaging materials used in the present invention are preferably capable of being processed simply by starting a pressrun, e.g. due to the mechanical friction between the material and a contacting cylinder or due to dissolution of the recording layer in the ink or fountain which are applied onto the printing surface. The materials described in the co-owned EP-As cited above can be processed by removing the non-exposed recording layer during the first few runs of the printing job. When the recording layer comprises a pigment or dye which absorbs visible light, its removal may be observed as a fog present in the non-printing areas of the first printed copies. Optionally, e.g. when a lower number of fogged copies is preferred, the imaging material can also be processed before printing, e.g. by rubbing with a dry cloth, a cotton pad or a rotating brush. One can also use a cloth which is moistened with a liquid, e.g. plain water or an organic liquid such as an alcohol or mixtures thereof. These optional processing steps may be performed on-press or off-press. The exposure and processing steps may also be performed in an apparatus which is mechanically coupled to the printing press so that the printing master can be transferred automatically to the printing press.

While the present invention will hereinafter be described in connection with preferred embodiments thereof, it will be understood that it is not intended to limit the invention to those embodiments.

EXAMPLES

In addition to the examples given below, further examples of imaging materials which are suitable for the printing method of the present invention, as well as methods for making such materials can be found in the co-owned and copending EP-As cited above.

Example 1

The surface of an anodized aluminum support was covered with a soot layer by contacting said surface with the flame of a Bunsen burner fed with natural gas. After coating the whole support, the layer was rubbed off with a dry cloth so as to obtain a thin layer of soot. The plate precursor thus obtained was image-wise exposed in heat-mode with a Nd:YLF (1060 nm) external drum (XTD) laser having a power of 738 mW and a scan speed of 8.0 m/sec. The plate was mounted on the cylinder of an AB DICK 360 (trade name) printing press and cleaned with a sponge moistened with plain water. A pressrun of 25000 copies was started using RUBBER BASE PLUS VS2329 Universal Black ink, trade name of Van Son, and TAME EC 7035 fountain, trade name of Anchor, the latter diluted with water 50-fold. The print quality was very good, throughout the pressrun.

After the pressrun, the soot layer was removed by a treatment with an atmospheric plasma jet using a PLASMATREAT® nozzle (trademark of Agrodyn Hochspannungstechnik GmbH, Steinhagen, Germany) at an operating RF voltage of 20 kV/18 kHz, generated by an Agrodyn frequency generator type FG1001 (in: 230 V, 50–60 kHz; out: 1 kV, 16–20 kHz) and an Agrodyn transformator type HTR1001 (in: 1 kV, 16–20 kHz; out: 20 kV, 16–20 kHz) (also trademarks of Agrodyn Hochspannungstechnik GmbH). After this cleaning step, the aluminum plate could be reused for making another printing master.

Example 2

An aluminum support was coated with a mixture of 12.5 g of silicone DEHESIVE 520, 1 g of VERNETZER V03 and 0.5 g of KATALYSATOR C09, all trade names of Wacker-Chemie GmbH (Münich, Germany), to obtain an ink-abhesive layer having a dry thickness of 10 $\mu$m. Silicone DEHESIVE 520 has an average molecular weight of about 5000. The sample was cured at 90° C. during 40 seconds and then rubbed in with a semi-burned cork. The recording layer thus obtained was tamped with a cotton pad so as to obtain a relatively homogenous top layer of soot.

A test pattern was exposed in heat-mode using an XTD Nd:YAG image-setter (spot-size at 1/e2: 23 $\mu$m) at a scan speed of 1 and 2 m/sec and a power of 350, 400 and 450 mW (six different exposures at distinct areas of each sample). The image pattern was visible immediately after exposure. The plate was then processed by rubbing with a cotton pad that was moistened with water while being mounted on the plate cylinder of an AB DICK 9860 printing press. A pressrun of 100 copies was started using REFLECTA DRY MAGENTA ink, trade name of Hostmann-Steinberg (Celle, Germany), without using a fountain.

After the pressrun, the plate was cleaned using the same apparatus as described in Example 1. The aluminum plate carrying said silicon layer could be reused for making another printing master.

What is claimed is:

1. A method of lithographic printing with a printing press comprising:

(i) making an imaging material by providing a support with an image recording layer, said imaging material comprising one or more layers containing a light absorbing compound in an amount not less than 50% by weight relative to all the layers of said imaging material, excluding the support;

(ii) making a printing master having a printing surface comprising ink accepting areas by image-wise exposing and optionally developing the imaging material;

(iii) starting a pressrun; and (iv) removing said ink accepting areas of said printing surface by treating said printing surface (1) with a plasma that is capable of operating at one atmosphere of pressure or (2) by directing an atmospheric plasma jet to said printing surface and scanwise moving said plasma jet relative to said printing surface.

2. A method according to claim 1 wherein the printing master is a wet lithographic printing master and the recording layer is provided on a hydrophilic support or on a hydrophilic layer which is carried by the support.

3. A method of lithographic printing with a printing press comprising:

(i) making an imaging material by providing a support with an image recording layer, wherein the recording layer comprises a light absorbing compound in an amount not less than 70% by weight;

(ii) making a printing master having a printing surface comprising ink accepting areas by image-wise exposing and optionally developing the imaging material;

(iii) starting a pressrun; and (iv) removing said ink accepting areas of said printing surface by treating said printing surface (1) with a plasma that is capable of operating at one atmosphere of pressure or (2) by directing an atmospheric plasma jet to said printing surface and scanwise moving said plasma jet relative to said printing surface.

4. A method according to claim 1 or 3 wherein the recording layer consists essentially of the light absorbing compound.

5. A method according to claim 1 or 3 wherein the light absorbing compound is carbon, graphite or soot.

6. A method of lithographic printing with a printing press comprising:

(i) making an imaging material by providing a support with an image recording layer;

(ii) making a printing master having a printing surface comprising.ink accepting areas by image-wise exposing and optionally developing the imaging material;

(iii) starting a pressrun; and (iv) removing said ink accepting areas of said printing surface by treating said printing surface (1) with a plasma that is capable of operating at one atmosphere of pressure or (2) by directing an atmospheric plasma jet to said printing surface and scanwise moving said plasma jet relative to said printing surface;

Wherein the printing master is a driographic printing master and the recording layer is provided on an ink-abhesive support or on an ink-abhesive layer which is carried by the support.

7. A method according to claim 1, 3 or 6 wherein all of steps (i) to (iv) are carried out in a printing press or in an apparatus that is mechanically coupled to the printing press and wherein the support is a cylinder of the printing press or a sheet, plate, belt or sleeve which is mounted on said cylinder.

* * * * *